US005596397A

United States Patent [19]

Shimada et al.

[11] Patent Number: 5,596,397

[45] Date of Patent: Jan. 21, 1997

[54] IMAGE FORMING APPARATUS PROVIDED WITH A HEAT PIPE WHICH HAS A CENTER LOCATED ON THE SHEET PASSAGE REFERENCE SIDE WITH RESPECT TO THE CENTER OF THE HEAT ROLLER

[75] Inventors: Takeichi Shimada; Takahiko Ushiroji, both of Hachioji, Japan

[73] Assignee: Konica Corporation, Japan

[21] Appl. No.: 573,499

[22] Filed: Dec. 15, 1995

[30] Foreign Application Priority Data

Dec. 20, 1994 [JP] Japan ..... 6-316435

[51] Int. Cl.[6] ..... G03G 15/20

[52] U.S. Cl. ..... 399/335; 219/469

[58] Field of Search ..... 355/285, 290; 219/216, 469; 432/59

[56] References Cited

FOREIGN PATENT DOCUMENTS 4-350888 12/1992 Japan .

5-181390 7/1993 Japan .

*Primary Examiner*—Joan H. Pendegrass
*Assistant Examiner*—Quana Grainger
*Attorney, Agent, or Firm*—Bierman and Muserlian

[57] ABSTRACT

An image forming apparatus, such as a copier or a printer, for forming an image on a recording sheet. The apparatus includes: a fixer for fixing the image on the recording sheet and having a heat roller. The fixer further includes: a pair of side ends in which a rotation axis of the heat roller passes through the pair of side ends; a heat pipe for regulating a temperature of the heat roller; and a conveyance path, having a reference position, for conveying the recording sheet in the fixing in which the recording sheet is conveyed along the reference position. In the fixer, the reference position is in a vicinity of one of side ends, and a center of the heat pipe in a direction of the rotation axis is positioned on the side end side with respect to a center of the heat roller.

4 Claims, 7 Drawing Sheets

50 HEAT ROLLER
53 HEATER LAMP
54 HEAT PIPE
P RECORDING SHEET
50 HEAT ROLLER
0
0'
ST
54 HEAT PIPE
53 HEATER LAMP
53 HEATER LAMP
54 HEAT PIPE
50 HEAT ROLLER
54
54
54
54
54

PRIOR ART

IMAGE FORMING APPARATUS PROVIDED WITH A HEAT PIPE WHICH HAS A CENTER LOCATED ON THE SHEET PASSAGE REFERENCE SIDE WITH RESPECT TO THE CENTER OF THE HEAT ROLLER

BACKGROUND OF THE INVENTION

The present invention relates to a heat-roller, a fixing means using this heat-roller, and to an image forming apparatus using this fixing means.

Recently, low power consumption is being demanded in image forming apparatus such as copiers, laser printers, etc. In these image forming apparatus, the section in which electric power is most consumed, is the fixing means by which toner on a recording sheet, onto which a toner image has been transferred, is fused and the toner image is fixed onto the recording sheet. Further, it is a heat-roller which is a heat source in the fixing means.

FIG. 5 is a structural view of a heat-roller disclosed in Japanese Patent Publication Open to Publication Inspection No. 55368/1985. FIG. 5(*a*) is a left end view, FIG. 5(*b*) is a frontal cross-sectional view, and FIG. 5(*c*) is a right end view. In FIG. 5, numeral 1 is a heat-roller, and numeral 2 is a recording sheet, wherein one side of the recording sheet is aligned with the reference position, the recording sheet is fed to the heat-roller 1, and a toner image is transferred onto the recording sheet.

A heater lamp 3, which is a heat source, is provided inside the heat-roller 1. Around the heater lamp 3, a plurality of heat pipes 4 (6 pipes in this example), by which heat is transmitted in the axial direction, are provided at equal angles.

Since this heat pipe 4 is expensive, the pipes 4 are not provided through the entire length of the heat-roller 1. The heat pipe 4 is provided as follows. The center (o') of the effective length in the axial direction of the heat pipe 4 is positioned on the side opposite of a reference for sheet passage (ST) with respect to the center (o) of the sheet passage width of the heat-roller 1.

The heat pipe 4 will be described below, while referring to FIG. 6. Each heat pipe 4 comprises: a sealed vacuum container; a porous sheet 6 provided inside the sealed container 5; and a working solution (water, freon, etc.) filling the sealed container 5.

Heat transmission of this heat pipe 4 is carried out as follows.

(1) When a portion of the heat pipe 4 is heated, the working solution is evaporated, and the vapor pressure increases. Thereby, the surface level of the working solution is lower than the porous sheet 6.

(2) The vapor pressure in the evaporation portion is higher than that in the condensation portion, and a pressure difference is caused, and the vapor flows to the condensation portion.

(3) The working solution in the condensation portion is cooled, condensed, and acts as a heat absorption source due to the latent heat of vaporization.

(4) The surface level of the solution in the condensation portion rises, and the surface of the solution tends to remain flat. Thereby, the working solution moves to the heating portion due to capillary phenomenon.

Temperature distribution of the heat-roller 1 when a small sized recording sheet continuously passes over the heat-roller 1, using such a heat pipe 4, is shown in FIG. 7. In this connection, for two cases, one in which the heat pipe 4 is used, and the other when no heat pipe 4 is used, the same electric power is applied.

In FIG. 7, in the case of no heat pipe (plotted by ○), the temperature is rapidly lowered toward the sheet passage reference position, which is a positional reference for the conveyance of the recording sheet, due to heat transmission to the recording sheet, and heat radiation of the heat-roller 1 from the edge of the sheet passage reference side.

On the other hand, in the case of the heat-roller using the heat pipe 4 (plotted by ●), there is almost no temperature change over the range in which the heat pipe 4 exists. The temperature is lowered from the portion at which the heat pipe 4 does not exist, toward the sheet passage reference position, due to the above-described reasons. However, the amount of temperature decrease is smaller than in the case of no heat pipe.

However, in the heat-roller 1 structured as described above, the heat pipe 4 does not exists in the vicinity of the sheet passage reference side. Accordingly, temperature decrease is inevitable in the vicinity of the sheet passage reference side.

Accordingly, in order to transfer the toner onto the recording sheet, it is necessary to set the temperature (t) at the sheet passage reference position higher than the fixing temperature (T). In this case, the temperature difference between the temperature at other portions, except the sheet passage reference position, and the fixing temperature, becomes large, and the power consumption still remains large, which is a problem.

SUMMARY OF THE INVENTION

The present invention is made to solve the above-described problems. An object of the present invention is to provide a heat-roller, in which the length of the heat type is shorter, and power consumption is smaller, and further, to provide a fixing means and an image forming apparatus using this heat-roller.

In order to solve the above-described problems, a heat-roller of the present invention is structured as follows. In a heat-roller, through which a recording sheet is fed so that one side of the recording sheet is aligned with the reference position, and inside of which a plurality of heat pipes are provided in the axial direction, the central position of the effective length in the axial direction of the heat pipe is located on the sheet passage reference side with respect to the central position of the sheet passage width of the heat-roller.

In order to solve the above-described problems, a fixing means of the present invention is structured as follows. The fixing means has a heat-roller inside of which a plurality of heat pipes are provided in the axial direction, wherein the central position of the effective length in the axial direction of the heat pipe is located on the sheet passage reference side with respect to the central position of the sheet passage width.

In order to solve the above-described problems, an image forming apparatus of the present invention is structured as follows. The image forming apparatus uses a fixing means having a heat-roller inside of which a plurality of heat pipes are provided in the axial direction, wherein the central position of the effective length in the axial direction of the heat pipe is located on the sheet passage reference side with respect to the central position of the sheet passage width.

In the fixing means and the image forming apparatus using a heat-roller of the present invention, when a heat pipe is provided such that the central position of the effective length in the axial direction of the heat pipes is located on the sheet passage reference side with respect to the central position of the sheet passage width, the temperature change of the heat-roller within the range through which the recording sheet passes, is eliminated, the required length of the heat pipes can be reduced, and power consumption can be reduced.

BRIEF DESCRIPTION OF THE DRAWINGS

FIG. 1(*a*) is a left end view, FIG. 1(*b*) is a frontal sectional view, and FIG. 1(*c*) is a right end view.

DETAILED DESCRIPTION OF THE INVENTION

In the fixing means and the image forming apparatus using a heat-roller of the present invention, when heat pipes are provided such that the central position of the effective length in the axial direction of the heat pipe is located on the sheet passage reference side with respect to the central position of the sheet passage width, the temperature change of the roller over the range in which the recording sheet passes, is eliminated, the required length of the heat pipe can be reduced, and electrical power consumption can be lowered.

EXAMPLES

Figure 1:
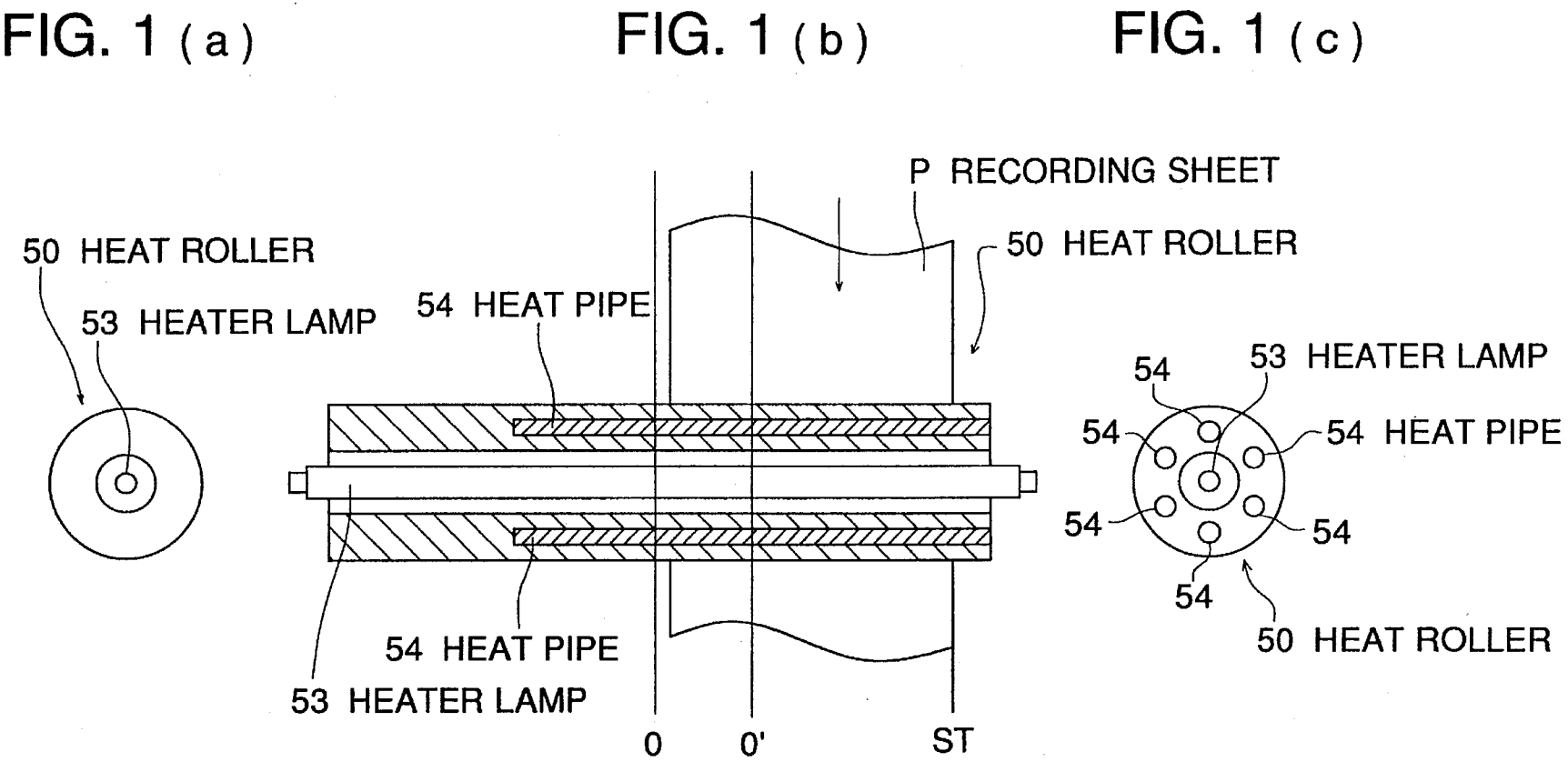
FIGS. 1(*a*), 1(*b*) and 1(*c*) are views showing a heat-roller of an example of the present invention.
Figure 2:
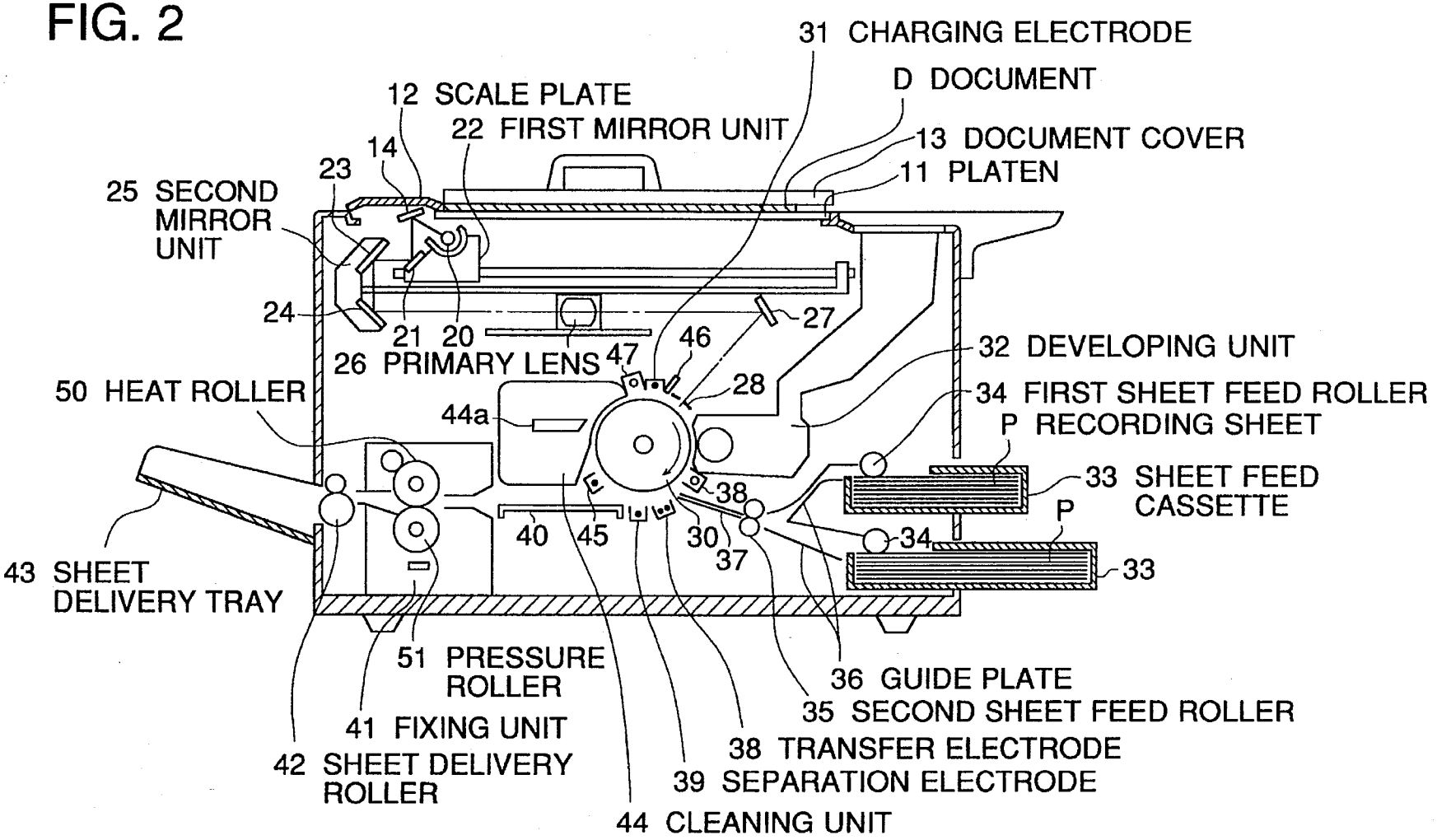
FIG. 2 is a structural view of a copier as an image forming apparatus in which the heat-roller shown in FIG. 1 is provided.

Next, an example of the present invention is explained below referring to the drawings. FIGS. 1(*a*), 1(*b*) and 1(*c*) are views showing a heat-roller used in an example of the present invention. FIG. 1(*a*) is a left end view, FIG. 1(*b*) is a frontal sectional view, and FIG. 1(*c*) is a right end view of the heat-roller. FIG. 2 is a structural view of a copier as an image forming apparatus in which the heat-roller shown in FIG. 1 is provided.

Initially, referring to FIG. 2, the overall structure of an image forming apparatus of the present invention will be described below. A platen, made of transparent glass, on which a document D is placed, is provided at the center of the upper portion of the copier main body. A scale plate 12 for determining a document's place position corresponding to sizes of the document D, is provided at the left end of the platen 11. Further, a document cover 13 to cover the placed document D, is provided over the platen 11, such that the document cover 13 can be closed toward an operator.

The document D is placed on the platen 11 according to indications of the scale plate 12, and is covered by the document cover 13, so that the document D is not dislocated. A display portion 14, using a reflection type liquid crystal, is provided near the intermediate position of the lower surface of the scale plate 12. A first mirror unit 22 having an exposure lamp 20 and the first mirror 21, is provided below the platen 11 and inside the copier main body, such that the first mirror unit 22 can move in parallel with the platen 11 and linearly in the horizontal direction in the drawing to scan the entire surface of the document D. A second mirror unit 25 composed of the second mirror 23 and the third mirror 24, which are integral on the unit 25, can move in the horizontal direction, in the drawing, at ½-th speed of the first mirror unit 22 so that a predetermined optical length can be secured, and further, the second mirror unit 25 can move longitudinally in parallel with the platen 11.

Reflected light from the document D on the platen 11 is entered into a main lens 26 after the light has been reflected by the first mirror 21, the second mirror 23 and the third mirror 24. The light sent from the main lens 26 enters a photoreceptor drum 30, which is an image carrier, through a slit 28, after it has been reflected from the fourth mirror 27.

An electrode 31 uniformly charges the photoreceptor drum 30. Accordingly, an electrostatic latent image is successively formed on the photoreceptor drum 30, which is rotated clockwise, by the incident light from the optical system. The electrostatic latent image formed on the photoreceptor drum 30 is visualized into a toner image by developing units 32.

On the other hand, a sheet feed device for feeding recording sheets comprises: sheet feed cassettes 33, in which recording sheets P are accommodated, (only two cassettes are shown in the drawing); the first sheet feed rollers 34 by which recording sheets P are successively fed (one by one) from the sheet feed cassettes 33; the second sheet feed rollers 35 by which the recording sheet P, fed by the first sheet feed rollers 34, is sent to the photoreceptor drum 30; and guide plates 36 and 37 which are respectively arranged between the sheet feed cassette 33 and the second sheet feed roller 35, and between the second sheet feed roller 35 and a transfer electrode, which will be described later.

In the copying operation, the recording sheet P in the selected sheet feed cassette 33 is fed by the first sheet feed roller 34, and is guided by the guide plate 36 to the second sheet feed roller 35. The second sheet feed rollers 35 (which are called register rollers) are driven in the timing in which the leading edge of the toner image on the photoreceptor drum 30 precisely meets the leading edge of the recording sheet P. That is, since it is necessary to carry out correct copying operations corresponding to the difference between sheet feed cassettes 33, the recording sheet P sent from one of the sheet feed cassettes 33 is temporarily stopped at the register rollers 35. When scanning of the optical system starts, the register rollers are driven in timed relationship with this scanning operation, in the timing in which the leading edge of the toner image on the photoreceptor drum 30 precisely meets the leading edge of the recording sheet P.

A transfer electrode 38 transfers the toner image formed on the photoreceptor drum 30 onto the recording sheet P. A separation electrode 39 separates the recording sheet P from the photoreceptor drum 30. The recording sheet P separated from the separation electrode 39, is sent to a fixing means 41 through a recording sheet conveyance means 40, and sandwiched between a heat-roller 50 and a pressure roller 51 in the fixing means 41. After the toner image on the recording sheet P is fused and fixed onto the recording sheet P, the recording sheet P is delivered on a delivery tray 43 by a sheet delivery roller 42.

After completion of the transfer process, the photoreceptor drum 30 is processed by a cleaning unit 44 so that any toner remaining on the photoreceptor drum surface 30 is removed. Then, the toner remaining on the surface of the photoreceptor drum 30 is scraped off by a blade 44*a* provided in the cleaning unit 44. In this case, in order to easily remove the remaining toner, a cleaning-discharging electrode 45 to discharge the AC corona is provided before the cleaning unit 44. A charge elimination portion 46 to eliminate non-image portions by a beam of light, is provided after the charging electrode 31, being opposite the photoreceptor drum 30. Numeral 47 is a pre-charging exposure portion, and numeral 48 is a pre-transfer exposure portion.

Figure 3:
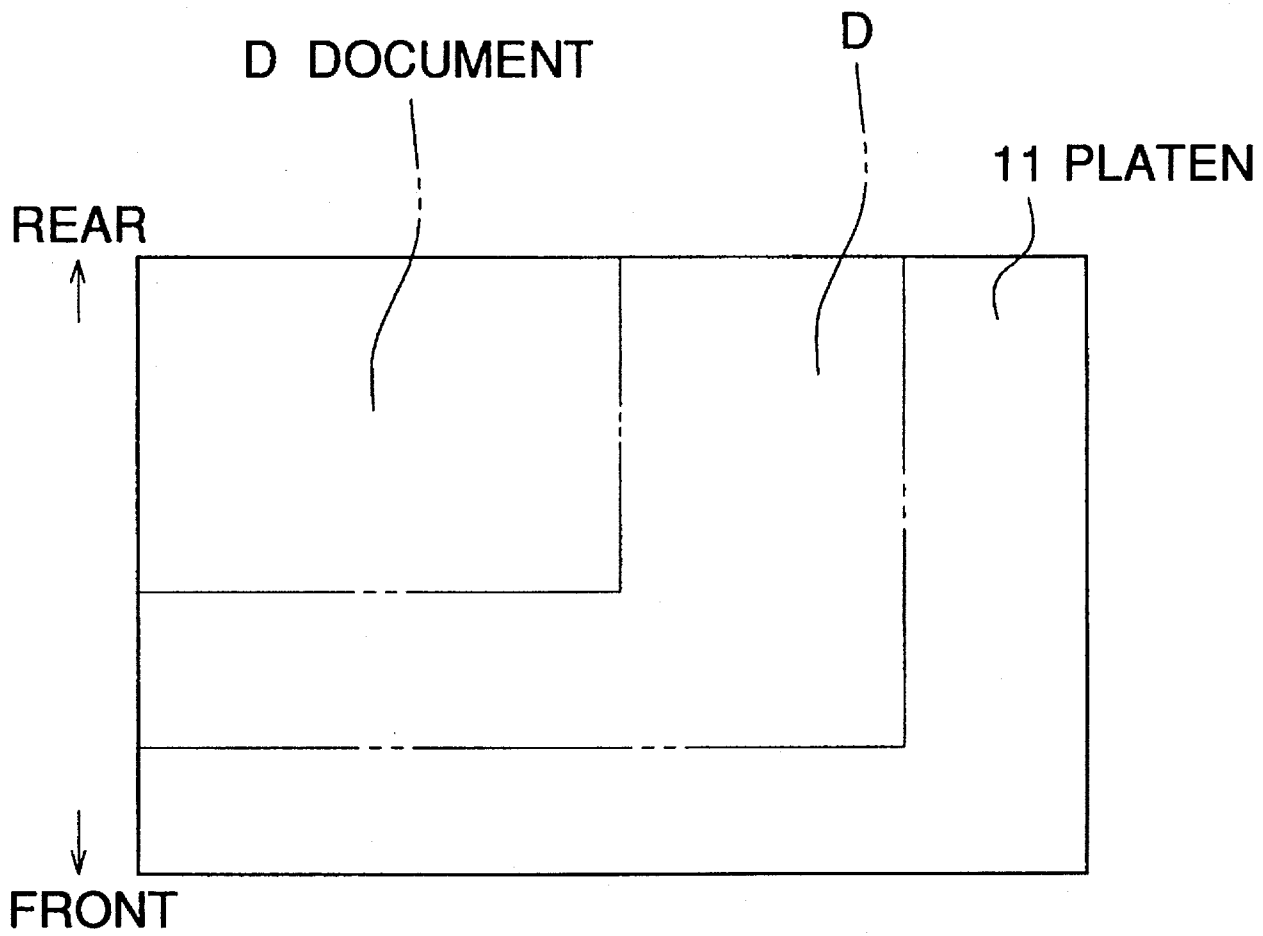
FIG. 3 is a structural view explaining a platen of the copier shown in FIG. 2.

As shown in FIG. 3, in the copier of this example, the reference position of the document D on the platen 11 is set such that the side opposite to the operator's side and the left side of the platen are set to the reference position for placing the document D, that is, one side of the document D is set to this reference position, (in this example, the reference position is facing the operator). Accordingly, the recording sheet P fed from the sheet feed cassette 33 is also conveyed in such a manner that the side opposite to the operator's side of each roller is the reference position for the recording sheet.

Referring to FIG. 1, a heat-roller 50 will be explained below. A heater lamp 53, which is a heat source, is provided inside the heat-roller 50. A plurality of heat pipes 54, which transmit the heat axially, (in this example, 6 heat pipes 54) are provided around the heater lamp 53 at equal intervals.

The central position (0') of the effective length in the axial direction of the heat pipes 54 is positioned on the operator's side, that is, on the sheet passage reference side (ST) with respect to the central position (0) of the sheet passage width of the heat-roller 50.

The temperature distribution of the heat-roller 50 at the time when small-sized recording sheets continuously pass the heat-roller 50 using this heat pipes 54, will be described referring to FIG. 4.

Figure 4:
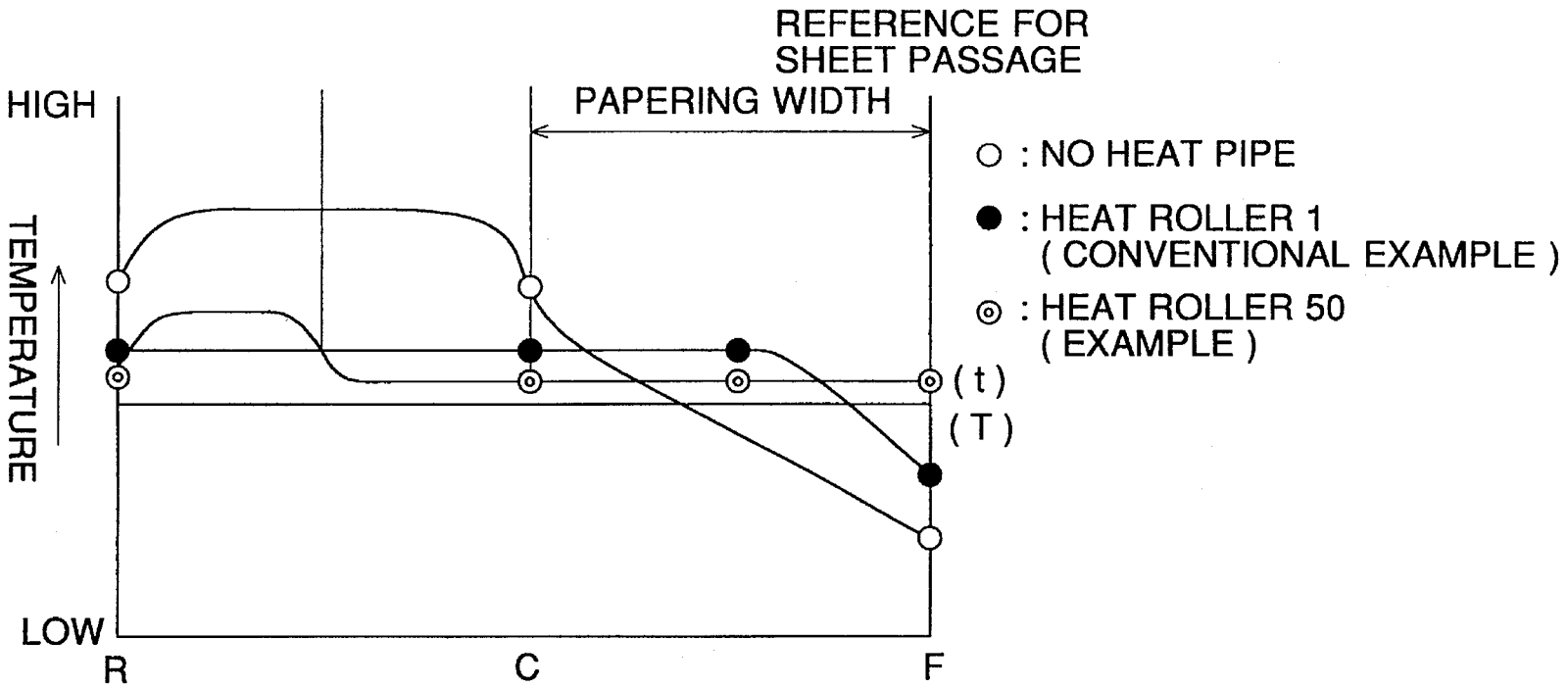
FIG. 4 is a view explaining temperature distribution of the heat-roller shown in FIG. 1.
Figure 5:
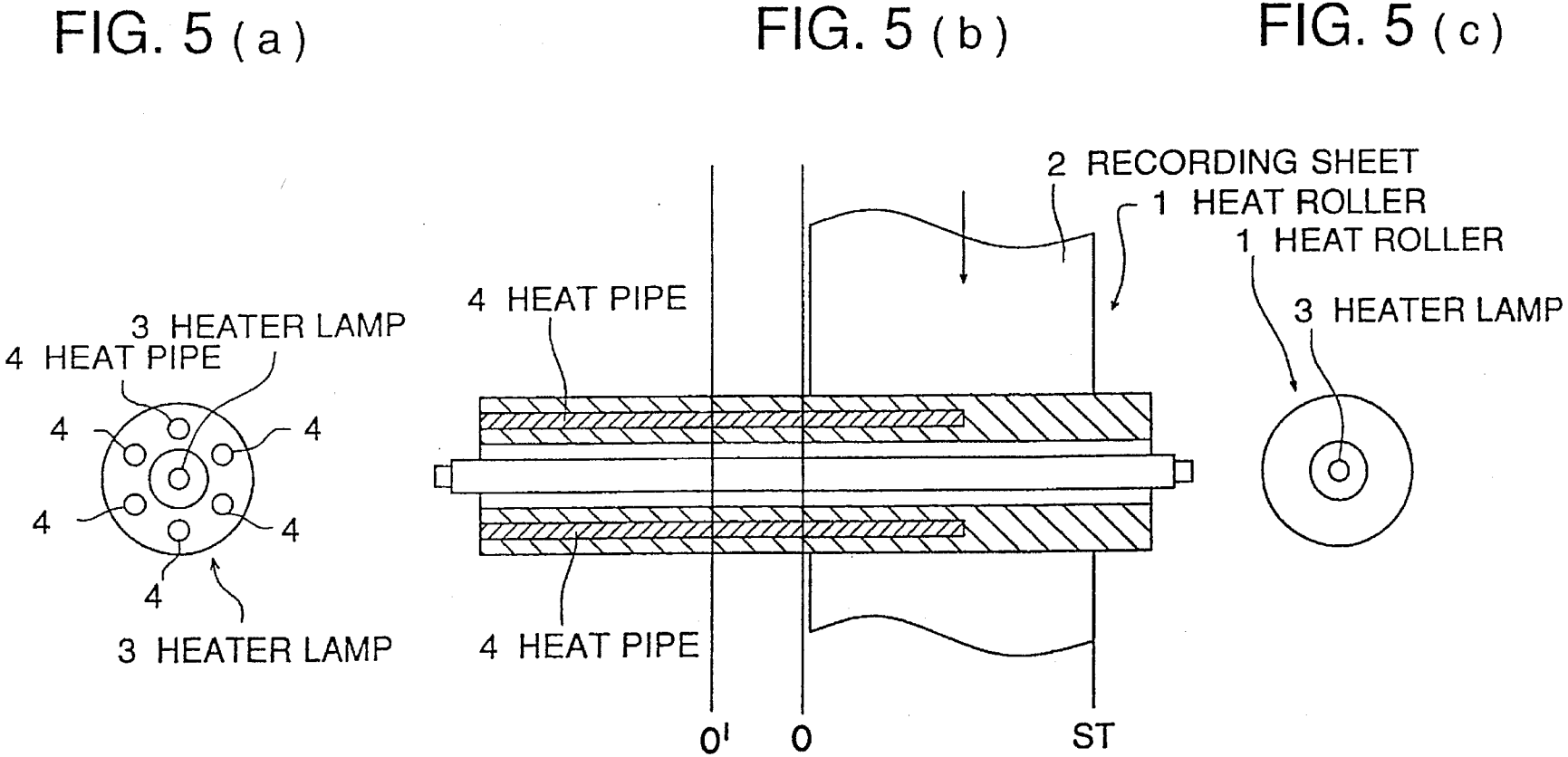
FIGS. 5(*a*), 5(*b*) and 5(*c*) are structural views of the heat-roller disclosed in Japanese Patent Publication Open to Public Inspection No. 55368/1985.
Figure 6:
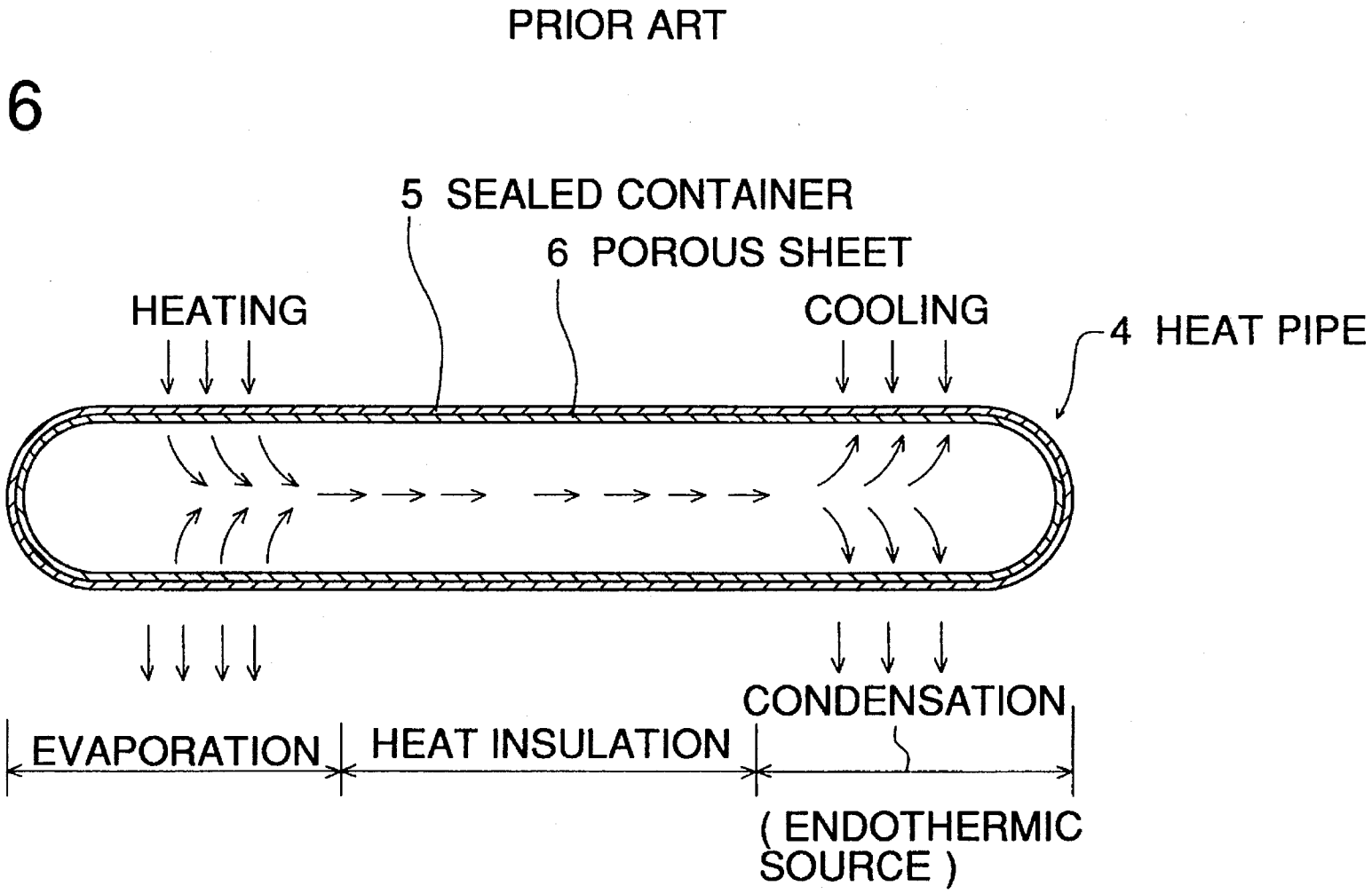
FIG. 6 is a sectional view of the heat pipe shown in FIG. 5.
Figure 7:
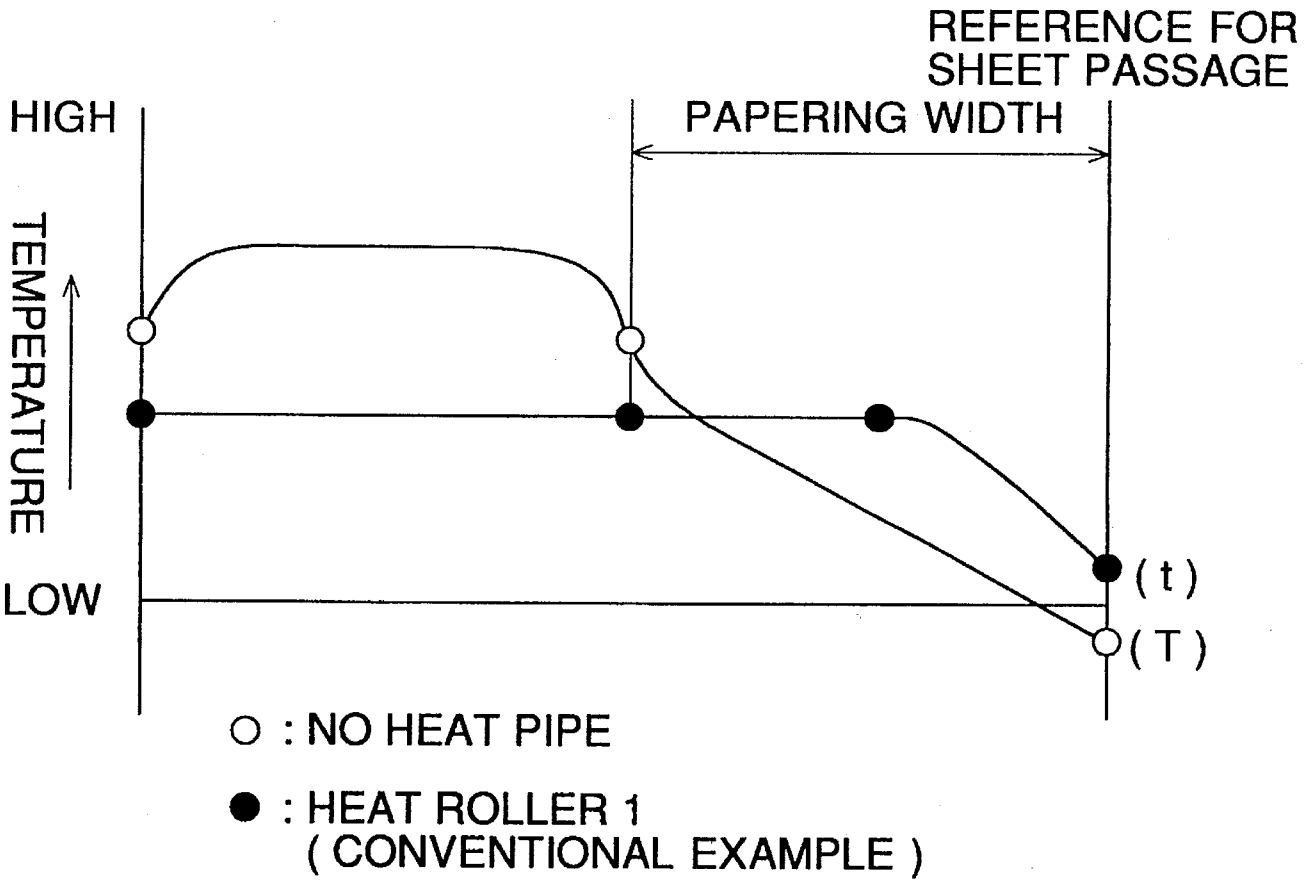
FIG. 7 PRIOR ART
FIG. 7 is a view explaining the temperature distribution of the heat-roller shown in FIG. 5.

In FIG. 4, when the heat pipes are not used, (plotted by ○), temperature is rapidly lowered toward the sheet passage reference position due to heat transmission onto the recording sheet, and heat radiation from the side ends of the heat-roller 50.

In the case of a heat-roller 1 using the heat pipes 4, described in the conventional example, the length of the heat pipes 4 is the same as that of the heat pipe 54 used in this example, (plotted by ●), the temperature is barely changed within the area that the heat pipes 4 exist. The temperature is lowered from the area where the heat pipes 4 do not exist, toward the sheet passage reference position, due to heat transmission onto the recording sheet and heat radiation from the side end of the heat-roller 1 on the sheet passage reference side.

However, the amount of temperature decrease is less than in the case of no heat pipe.

In the heat-roller 50 using heat pipes 54 as in this example, (plotted by ◎), the central position (0') of the effective length in the axial direction of the heat pipe 54 is positioned on the sheet passage reference side (ST) with respect to the central position (0) of the sheet passage width of the heat-roller 50. Thereby, in spite of heat transmission onto the recording sheet, and heat radiation from the ends of the heat-roller on the sheet passage reference side, the temperature of the heat-roller 50 is almost constant (t) within the range in which the recording sheet P passes. Within the range of no heat pipe 54, the temperature of the heat-roller 50 is increased more than the temperature (t), and the temperature is decreased in the vicinity of the end opposite to the sheet passage reference side, due to the heat radiation from the end.

Consequently, the effectiveness of heat pipes 54 can be maximized when the width frequently contacted by the recording sheets is within the effective length of heat pipes 54. Further, even when the width of the recording sheet is wider than the effective length of heat pipes 54, the fixing operation can still be performed properly for a lesser number of recording sheets. This is because the recording sheets absorb the heat from the portion without the heat pipes since that portion is usually heated up enough before the fixing operation. Therefore, according to the configuration of the present invention, the effectiveness of the heat pipes for evening the temperature of the heat-roller 50 is maximized.

Electric power, supplied to the above-described 3 types of heat-rollers, is constant.

Accordingly, by this example, the temperature (t) within the range in which heat pipes 54 exist, can be almost equal to the fixing temperature (T) to fix the toner onto the recording sheet P, and even when the length of heat pipes 54 is short, the electric power consumption can be lowered more than that of the conventional example.

According to the present invention, as described above, the central position of the effective length in the axial direction of the heat pipe is positioned on the sheet passage reference side with respect to the central position of the sheet passage width of the heat-roller. Thereby, a heat-roller, a fixing means and an image forming apparatus can be realized, in which the temperature change of the heat-roller, within the range in which the recording sheet passes, is eliminated; and the length of the heat pipe can be shortened and electric power consumption can be reduced.

What is claimed is:

1. A fixing apparatus for fixing an image on a recording sheet, comprising;

a heat roller, including:

a pair of side ends wherein a rotation axis of said heat roller passes through said pair of side ends; and a heat pipe, having a length shorter than a length of said heat roller, for regulating a temperature of said heat roller; and a conveyance path, having a reference position side in a vicinity of one of said pair of side ends, for conveying said recording sheet in said fixing apparatus wherein said recording sheet is conveyed along said reference position side;

wherein a center of said heat pipe in a direction of said rotation axis is positioned on the reference position side of said one of said pair of side ends with respect to a center of said heat roller.

2. The fixing apparatus of claim 1, wherein one end of said heat pipe and said one of said side ends of said heat roller are trued up at a same position.

3. An image forming apparatus for forming an image on a recording sheet, comprising:

a fixing means for fixing said image on said recording sheet, including:

a heat roller, further including:

a pair of side ends wherein a rotation axis of said heat roller passes through said pair of side ends;

a heat pipe, having a length shorter than a length of said heat roller, for regulating a temperature of said heat roller; and a conveyance path, having a reference position side in a vicinity of one of said pair of side ends, for conveying said recording sheet in said fixing means wherein said recording sheet is conveyed along said reference position side;

wherein a center of said heat pipe in a direction of said rotation axis is positioned on the reference position side of said one of said pair of side ends with respect to a center of said heat roller.

4. The image forming apparatus of claim 3, wherein one end of said heat pipe and said one of said side ends of said heat roller are trued up at a same position.

* * * * *